United States Patent [19]

Crawford et al.

[11] Patent Number: 4,867,308

[45] Date of Patent: Sep. 19, 1989

[54] STORAGE TAPE FOR ELECTRONIC COMPONENTS

[76] Inventors: Richard J. Crawford, 26861A Avenue of the Oaks, Newhall, Calif. 91321; Manuel Talamantez, 16719 Gledhill St., Sepulveda, Calif. 91343

[21] Appl. No.: 49,540

[22] Filed: May 14, 1987

[51] Int. Cl.[4] ..... B65D 73/02

[52] U.S. Cl. ..... 206/330; 206/334; 206/328; 206/390

[58] Field of Search ..... 206/328, 334, 330, 345, 206/346, 347, 390, 499, 329, 331, 332, 497

[56] References Cited

U.S. PATENT DOCUMENTS

| | | | |
|---|---|---|---|
| 3,388,465 | 6/1968 | Johnston | 206/329 |
| 3,443,683 | 5/1969 | Felty, Jr. et al. | 206/330 |
| 3,444,993 | 5/1969 | Lunsford | 206/330 |
| 3,465,874 | 9/1969 | Hugle et al. | 206/330 |
| 4,621,486 | 11/1986 | Slavicek | 206/330 |
| 4,702,788 | 10/1987 | Okui | 206/330 |
| 4,708,245 | 11/1987 | Boeckmann et al. | 206/330 |
| 4,733,778 | 3/1988 | Boeckmann et al. | 206/332 |
| 4,736,841 | 12/1988 | Kaneko et al. | 206/332 |
| 4,767,004 | 8/1988 | Ishihara et al. | 206/497 |
| 4,778,326 | 10/1988 | Althouse et al. | 206/330 |

*Primary Examiner*—David T. Fidei

*Attorney, Agent, or Firm*—Beehler, Pavitt, Siegemund, Jagger, Martella & Dawes

[57] ABSTRACT

A composite tape for the storage and delivery of very small electronic components makes use of a carrier strip with pockets for containment of individual components and a cover strip. The cover strip extends over all the pockets to hold the components in the pockets until needed. Sprocket holes extend along the side of the carrier strip and are used for reeling up long composite tapes when loaded and for unreeling when components are to be removed. At the time of removal two take-up reels are used. One of the take-up reels pulls the cover strip away from the carrier strip to uncover the pockets. The other take-up reel progressively rolls up the carrier strip after the components have been lifted from the pockets. Various expedients are used for releasably securing the cover strip to the carrier strip.

2 Claims, 4 Drawing Sheets

Fig. 7.
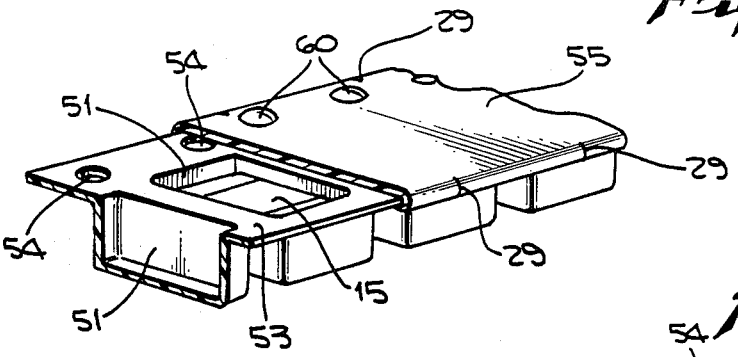
Fig. 8.
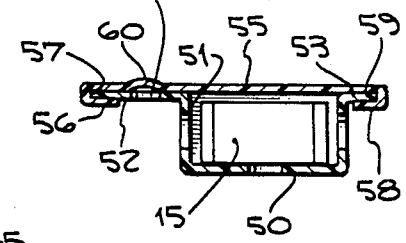
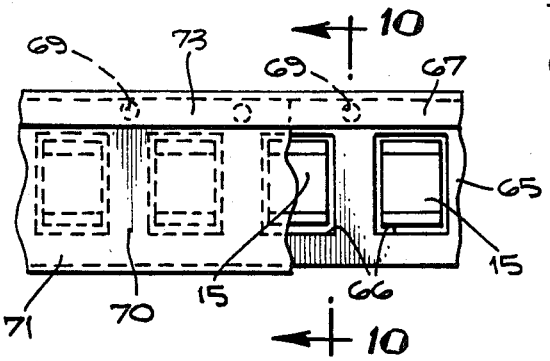
Fig. 9.
Fig. 10.
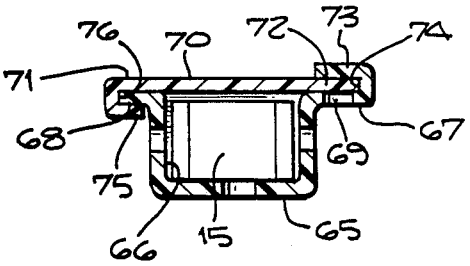
Fig. 12.
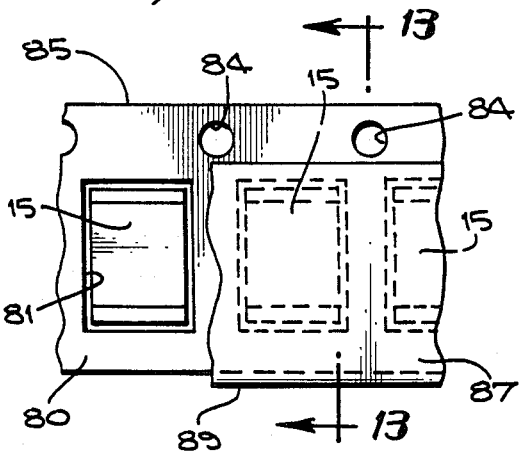
Fig. 13.
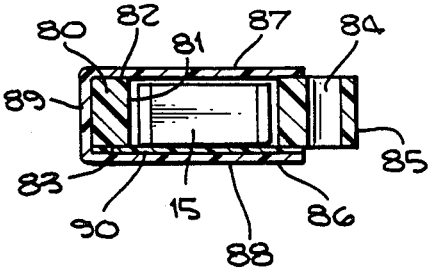

Fig. 14.
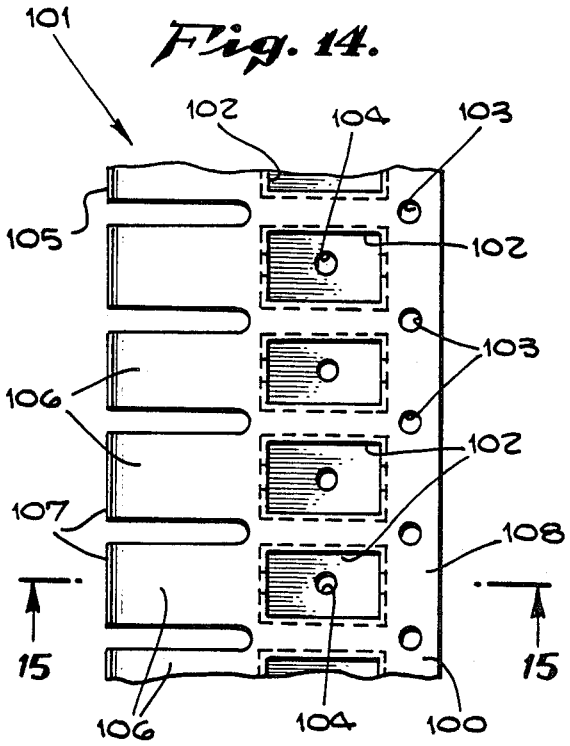
Fig. 16.
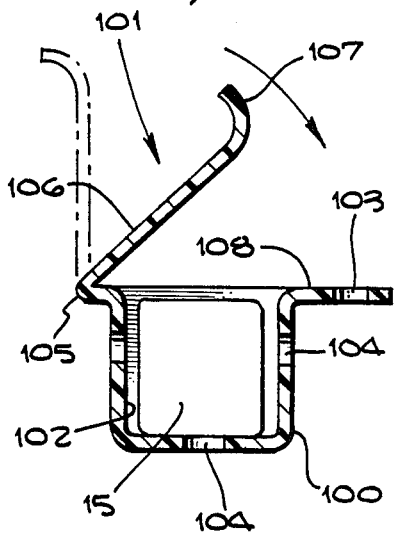
Fig. 17.
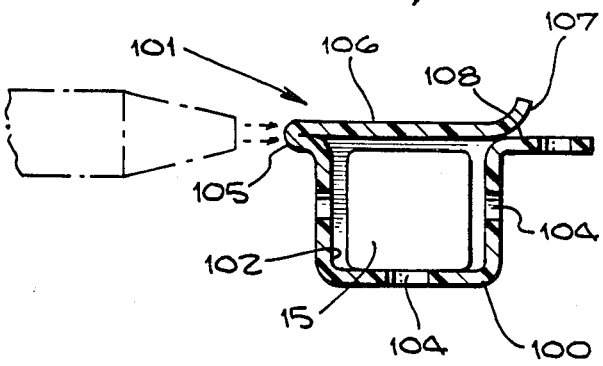
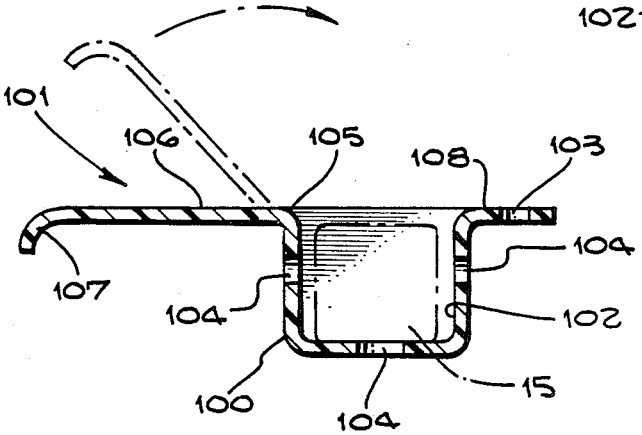
Fig. 15.

STORAGE TAPE FOR ELECTRONIC COMPONENTS

The invention here involved is in the field devoted to the storage and retrieval of microelectronic components. A practice has developed in the industry of using composite storage tapes provided with sprocket wheel holes and in which microelectronic components are trapped. Such composite tapes are wound on a reel after being loaded with components and stored until needed. The microelectronic components and the pockets to receive them are customarily so small that hundreds of pockets are provided in a single reel of the composite tape. An attempt is made to hold the size of the pockets to relatively close tolerances to preserve the orientation of the component in the pocket so that when the time comes to unload the tape, a robot is employed to lift the component from the pocket and accurately position it in the circuit of a printed circuit board.

Heretofore the composite tape has customarily consisted of a carrier strip in which the pockets are formed for reception of the microelectronic components and a cover strip applied over the carrier strip to cover the pockets once they have been loaded in order to hold the components in place. Carrier strips have been of different kinds, some consisting of chip board, which is a paper-like substance, in which holes are punched to provide pockets. Sprocket holes are punched on one or both edges of the carrier strip and a bottom strip is adhesively applied to one side of the carrier strip to provide a bottom for the pockets. After the pockets have been loaded progressively with the microelectronic components, a cover strip is applied to the opposite face of the carrier strip and adhesive attached.

On other occasions, the carrier strip has been one of a synthetic, plastic resin material of appropriate composition and consistency in which pockets are embossed. Here again, however, after the pockets have been loaded with microelectronic components, the cover strip is applied to the top face of the carrier strip with an adhesive attachment of some kind.

Irrespective of the character of the material employed, the accepted procedure when unloading has been to attach the free end of the cover strip to one reel and the corresponding end of the carrier strip to another reel, both provided with appropriate sprockets, and disengaging the carrier strip from the cover strip by pulling on both strips to break the adhesive seal. Once the pocket has been exposed by this procedure, the microelectronic component is extracted from the pocket, usually by a robotic extractor, and thereafter placed in operative position on an appropriate circuit board.

There is appreciable need for precision in the delivery of microelectronic components in this fashion because each in turn must be picked up carefully and precisely positioned on the circuit board. The procedure also must be reliable to such an extent that there be no interruptions or miscarriages in the delivery of the microelectronic components in that, should even one be inaccurately positioned on the circuit board, the circuit board will be faulty and need to be discarded. Further still, should a faulty board be inadvertently included in an apparatus, the entire apparatus will be faulty.

A notable characteristic of composite tapes which rely on a carrier strip having the cover strip adhesively applied to it has been the lack of consistency of the adhesive bond. This inconsistency may arise from an assortment of reasons, the end result of which is comparable. On some occasions, the adhesive bond may be too strong, making removal of the cover strip from the carrier strip difficult and irregular. More frequently, the bonding between the carrier strip and the cover strip will be too irregular. Under such circumstances, when the cover strip is pulled loose from the carrier strip, the pulling operation also has irregularities, frequently causing microelectronic components to bounce from the open pocket before being properly grasped by the robot, or perhaps disturbed to such a degree that robotic contact will not be accomplished. In any event, the result is a jamming of the unloading operation.

Cover strips with an insufficient adhesive attachment to the carrier strip experience comparable irregularities in the delivery of the microelectronic components. The irregularities mentioned exist for strips which are bonded by a heat sealing procedure as well as those which are bonded by use of an adhesive.

It is therefore among the objects of the invention to provide a new and improved composite storage tape in which a cover strip is attached to a carrier strip in a dependable uniform fashion and with an attachment such that there is no lack of uniformity or disturbance of the carrier strip when the microelectronic component is to be extracted.

Another object of the invention is to provide a new and improved composite storage tape for electronic components, and particularly those of microelectronic character, wherein the attachment of the cover strip to the carrier strip is by some means other than an adhesive attachment.

Still another object of the invention is to provide a new and improved composite storage tape for microelectronic components wherein a readily releasable mechanical attachment is relied upon to secure the cover strip to the carrier strip.

Still another object of the invention is to provide a new and improved composite storage tape for microelectronic components wherein the attachment between the cover strip and the carrier strip is such as to be unaffected by wide changes in temperature.

Further included among the objects of the invention is to provide a new and improved composite storage tape for microelectronic components which not only avoids an adhesive attachment of the cover tape to the carrier tape, but also is of such character as to be applicable to tapes of various sizes and breadths.

Further included among the objects of the invention is to provide a new and improved storage tape for microelectronic components wherein the attachment between the cover strip and the carrier strip is of such character that neither suffers damage or change by virtue of being forcibly separated at the extraction phase of the operation so that both strips may be capable of reuse in virtually the same arrangement.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

IN THE DRAWINGS:

FIG. 7 is a fragmentary isometric view of a second form of the device.

FIG. 8 is a cross-sectional view of the device of FIG. 7.

FIG. 9 is a plan view of still another form of the device.

FIG. 10 i s a cross-sectional view taken on the line 10—10 of FIG. 9.

Figure 11:
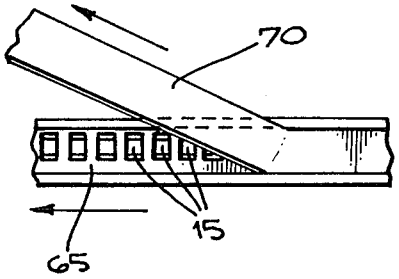

FIG. 11 is a fragmentary elevational view showing a variation of the device of FIGS. 9 and 10 at the unloading stage.

FIG. 12 is a fragmentary plan view of an alternate form of the device.

FIG. 13 is a cross-sectional view on the line 13—13 of FIG. 12.

FIG. 14 is a fragmentary plan view of still another form of the invention.

FIG. 15 is a cross-sectional view on the line 15—15 of FIG. 14.

FIG. 16 is a cross-sectional view similar to FIG. 15 showing a successive position of parts.

FIG. 17 is a cross-sectional view similar to FIG. 15 showing the device in closed position. In one embodiment of the invention depicted in FIGS. 2, 3, 4 and 6, there is shown a storage tape, indicated generally by the reference character 10, consisting of two strips, namely, a carrier strip 11 and a cover strip 12. In the carrier strip is a multiple number of pockets 13 at longitudinally spaced locations throughout the length of the carrier strip which leaves lands 14 intermediate adjacent pockets.

The pockets are designed for reception of electronic components 15, some being as small as those commonly designated as microelectronic components. Although in the chosen embodiment the pockets have a rectangular configuration in order to receive components likewise of a rectangular configuration with a desirable degree of tolerance, the configuration may vary as need demands.

It is additionally desirable to provide test slots 16 on one or both end faces 17, 17' so that, if desired, test probes 18 may be inserted into engagement with contacts 19 of the component, should testing of the component be required after having been packaged in the storage tape. Following conventional practice, sprocket holes 20 are provided in the carrier tape. In the chosen embodiment only one set of sprocket holes are shown. Occasions may be encountered, however, where sprocket holes are made use of on both sides.

Further, in the chosen embodiment there is a relatively wide lateral section 21 on one side, containing the sprocket holes 20, and a relatively narrow lateral section 22 on the opposite side. In this embodiment the relatively wide lateral section 21 has a reversely folded section 23 forming a recess 24. As shown, there is a bottom 25 between the lateral sections 21 and 23. Somewhat similarly on the opposite side, there is a reversely folded section 26 which, in company with a bottom 27, forms a recess 28.

In that the reversely folded sections 23 and 26 in company with the corresponding bottoms 25 and 27 tend to render the carrier strip relatively stiff, sufficient to impair storage on a reel, there are provided transverse slits 29 at spaced locations throughout the length of the carrier strip to facilitate bending.

In order to hold the components in position in the pockets during handling as well as during storage, the cover strip 12 previously identified is applied. The cover strip has respective side edges 32 and 33 which engage corresponding recesses 24 and 28, thereby to releasably hold the cover strip in position covering the various pockets 13. It has also been found advantageous to provide cut-outs 34 in the cover strip 12 at the location of the sprocket holes 20 to make certain that there is no interference with proper sprocket grip on the tape when it is being handled.

Figures 1, 2, 3, 4:
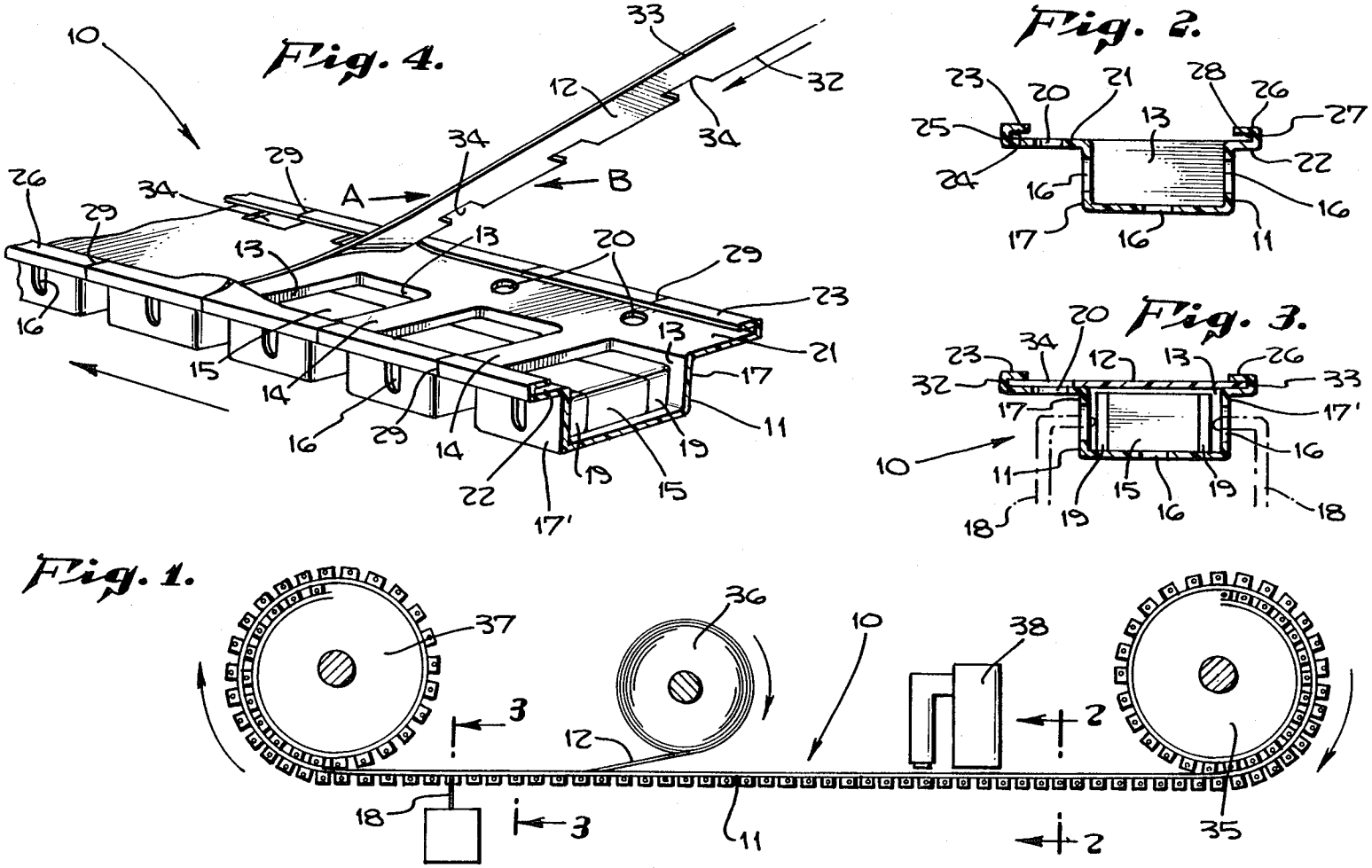
FIG. 1 is a side elevational view of a schematic representation of the device in use at the loading stage.
FIG. 2 is a cross-sectional view on the line 2—2 of FIG. 1.
FIG. 3 is a cross-sectional view on the line 3—3 of FIG. 1.
FIG. 4 is a fragmentary isometric view showing application of the cover strip at the loading stage.

When the carrier strip 11 is being made ready for use, it is customarily in the form of a reel 35, as shown in FIG. 1. Similarly the cover strip 12 is in the form of a reel 36. There is a take-up reel 37 for rolling up the combined carrier strip 11 and cover strip 12, then in the form of a storage tape 10 after loading has taken place. Customarily a placement robot device 38 is employed to deposit components 15, one at a time, in the pockets 13 as the carrier strip 11 is drawn past the placement robot device by action of the take-up reel 37. A succeeding step involves simultaneously drawing the cover strip 12 from its reel 36, also by action of the take-up reel 37. Since the breadth of the cover strip 12 is in excess of the distance between inside edges of the respective reversely folded sections 23 and 26, it may be advisable to apply pressure in the direction of arrows A and B to impart to the cover strip a slight curvature, as depicted in FIG. 4, making the effective distance between opposite edges smaller than the distance between the reversely folded sections at the time of entry of the edges of the cover strip into the recesses 22 and 24, whereafter the cover strip, on being released, spreads outwardly to its full width and is appropriately captured by the recesses in a position covering the pockets in order to retain the components in place. A secure closure is in this manner effectively accomplished without need for employment of an adhesive of any kind.

Figure 6:
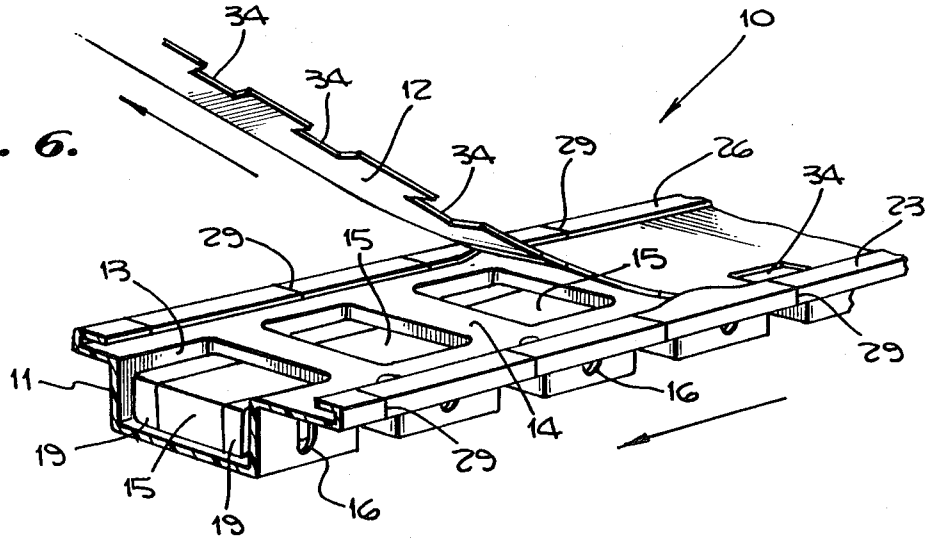
FIG. 6 is a fragmentary isometric view showing the unloading stage.
Figure 5:
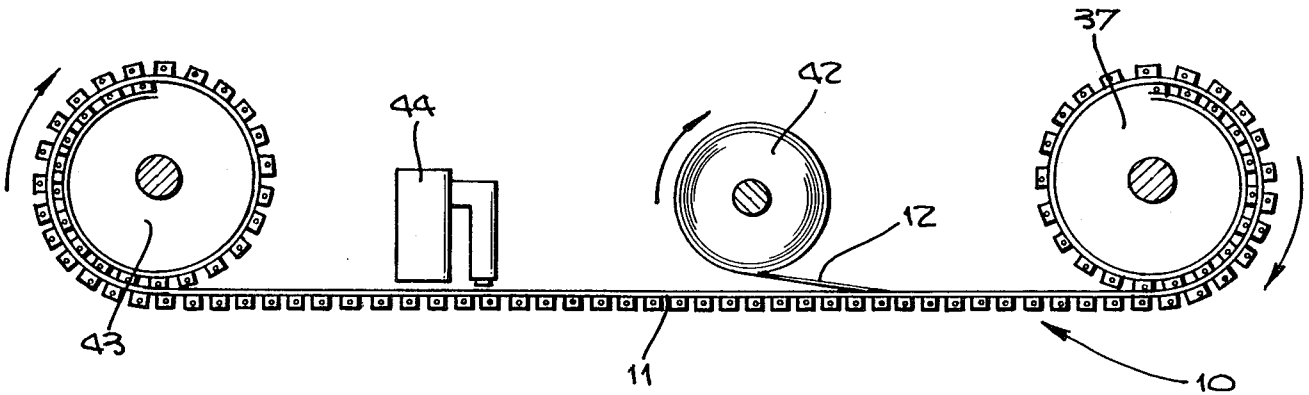
FIG. 5 is a side elevational view of a schematic representation of the device at the unloading stage.

When the occasion arises to unload the storage tape from the take-up reel 37 serving as a storage reel, two removal reels are employed, one consisting of a cover strip removal reel 42, and the other consisting of a carrier strip removal reel 43, as depicted in FIG. 5. Since the cover strip is merely held in retained position by action of the reversely folded sections 23 and 26, those sections yield when the cover strip is placed under tension, as depicted in FIG. 6, and the pockets 13 are then uncovered to expose the components 15. Once the components have been exposed, they are ready for unloading by action of an unloading robot device 44, after which, following conventional practice, they are placed in an appropriate circuitry.

Further, in view of there being no permanent deformation of either the cover strip 12 or the carrier strip 11, after being rolled up on the reels 42 and 43, both strips are again capable of being reused in the same fashion as heretofore described.

In an embodiment of the invention as depicted in FIGS. 7 and 8, a carrier strip 50 provided with pockets 51 has one relatively wide lateral section 52 and one relatively narrow lateral section 53, with both lateral sections lying in the same plane. Sprocket holes 54 are located in the lateral section 52. On this occasion a cover strip 55 extends entirely carrier strip and provides a reversely folded section 56 forming a recess 57 for reception of the corresponding edge of the lateral section 52. On the opposite side a reversely folded section 58 forms a recess 59 of the lateral section 53. It is additionally advisable to make use of raised portions 60 at the location of the sprocket holes 54 to provide the same assurance as the cut-outs previously made reference to in the initially described form of the invention.

In making use of this form of the invention, it may be advisable to laterally deform either the cover strip, the carrier strip, or both when they are to be engaged at the loading stage, and also, should it be desirable, when the cover strip is to be removed at the unloading stage.

In still another form of the invention as depicted in FIGS. 9 and 10, there is a carrier strip 65, provided with pockets 66, having one relatively wide lateral section 67 and another relatively narrow lateral section 68, the lateral section 67 being one provided with sprocket holes 69. On this occasion a cover strip 70 has a relatively wide lateral section 71 and a relatively narrow lateral section 72. The lateral section 67 of the carrier strip is made long enough to provide a reversely folded section 73 which forms a recess 74 for reception of the corresponding lateral section 72 of the cover strip 70. Conversely, on the other side of the composite tape thus formed, there is a reversely folded section 75 of the cover strip 70 forming a recess 76 for reception of the relatively narrow lateral section 68 of the carrier strip 65.

In an arrangement of this kind for loading and unloading the carrier strip and cover strip may be disposed angularly with respect to each other, as depicted in FIG. 11, rather than resorting to lateral deformation. As so depicted in FIG. 11, for the unloading stage the cover strip 70 is drawn angularly away from the carrier strip 65 so as to uncover the components 15. Conversely, during the loading operation the cover strip may be directed angularly toward the carrier strip so as to reengage the edges with their corresponding recesses.

In still another form of the invention shown in FIGS. 13 and 14, there is provided a carrier strip 80, having a thickness sufficient to provide pockets 81 of the depth between opposite faces 82 and 83 sufficient to contain components of the sort to be stored. Sprocket holes 84 are provided at the corresponding edge 85. Any desirable material may be employed for the carrier strip such, for example, as the conventional chipboard material from which pockets can be punched, or an appropriate epoxy resin.

For closing both ends of the pockets there is employed a containment strip 86 which appears somewhat U-shaped in cross section, as depicted in FIG. 13. The containment strip consists of cover sections 87 and 88 attached together by an interconnecting section 89. The cover sections 87 and 88 are made sufficiently narrow to leave the sprocket holes 84 exposed. As an additional convenience there is included a bottom strip 90 between one face 83 of the carrier strip and the corresponding cover strip 88. The bottom strip serves as a means for temporarily holding components in position in the pocket both during the loading process when the containment strip is being applied and at the unloading stage when the containment strip is being removed. Material of relatively low friction characteristic is preferable for the bottom strip.

At the loading stage for the form of invention of FIGS. 12 and 13, the preferable approach is an angular disposition of the containment strip with respect to the carrier strip, as suggested in the description of FIG. 11. Similarly, when the containment strip is to be removed at the unloading stage, it can be drawn obliquely sideways in order to disengage it from the carrier strip.

In the form of invention of FIGS. 14 through 17 there is a somewhat different approach in that a carrier strip 100 and a cover strip 101 comprise a single integral mass of material, preferably of an appropriate synthetic plastic resin which can be made flexible when heated and which, upon cooling, becomes inflexible by hardening to a degree. On this occasion pockets 102 may be embossed in the carrier strip, provided with sprocket holes 103 and, if preferred, appropriate service slots 104. The pockets 102 are, as in the previously described forms, multiple in number and spaced longitudinally throughout the length of the carrier strip.

The cover strip 101, being of the same material, is joined to a corresponding edge of the carrier strip by what may be appropriately designated as a hinge section 105. Additionally, as a convenience at both the loading and unloading stages, the cover strip 101 is separated into a multiple number of tabs 106, there being one tab for each pocket. As a further convenience, each tab may be provided with a lip 107 to facilitate handling, especially at the unloading stage. Although the lip has been shown as a part of the tab of the cover strip, it should be understood that other appropriate means as, for example a depression in the corresponding edge section of the carrier strip may be relied upon for serving a comparable purpose, namely, to secure a grip on the tab so that it can be lifted clear.

At the loading stage each tab 106 of the cover strip 101 is lifted to entirely clear the pocket so that components may be deposited. When the tab is swung to a position lying in the same plane as the plane of the carrier strip, both strips together can be rolled and unrolled on a reel with greater ease. At the loading stage the hinge section 105 is made flexible as, for example, by heating, so that the tab can then be swung to a position over the pocket so that the portion of the tab adjacent the lip 107 is pressed into engagement, or at least close to engagement, with a margin strip section 108 of the carrier strip 100. When this has been accomplished, the hinge section 105 is made less flexible as, for example, by cooling or allowing the material of the hinge section to cool. In this way the tab holds its covering position while the composite tape is being wound for storage and ultimately unwound at the unloading stage.

When unloading is to be accomplished, the hinge section 105 is again made flexible as, for example, by reheating so that, with the assistance of the lip 107, the tab can be lifted clear of the pocket to permit extraction of the component.

While particular embodiments of the present invention have been shown and described, it will be obvious to those skilled in the art that changes and modifications may be made without departing from the invention in its broader aspects, and therefore the aim of its appended claims is to cover all such changes and modifications as fall within the true spirit and scope of this invention.

Having described the invention, what is claimed as new in support of Letters Patent is as follows:

1. A tape for the storage and retrieval of electronic components comprising a carrier substrip of temperature responsive synthetic plastic resin sheet material having a multiple number of pockets at a succession of longitudinally spaced locations and a cover substrip for covering said pockets while said storage tape is in a coil for storage, said carrier and cover substrips being a single composite strip of said sheet material, releasable retention means for holding the cover substrip over and in engagement with the carrier substrip when components are in said pockets, said retention means comprising the material of adjacent edge portions of the substrips, said material of said adjacent edge portions having a retention condition when said material is at one temperature condition in a relatively inflexible state, said cover substrip having a release condition for removal from a position over the pockets when said material of said edge portions of the substrips is at another temperature condition in a relatively flexible state, said carrier substrip and said cover substrip being a single integral composition of substantially uniform thickness with said edge portions at one side of said band being in continuous engagement and edge portions on the opposite side of said band being separate from each other.

2. A tape for storage and retrieval of electronic components as in claim 1 wherein those portions of the cover strip over the respective pockets are spaced from each other in a longitudinal direction.

* * * * *